US006351951B1

(12) United States Patent
Guo et al.

(10) Patent No.: US 6,351,951 B1
(45) Date of Patent: Mar. 5, 2002

(54) THERMOELECTRIC COOLING DEVICE USING HEAT PIPE FOR CONDUCTING AND RADIATING

(76) Inventors: Chen Guo; Junling Gao; Aimin Zhang, all of No. 368, Xinshibeilu, Shijiazhuang City, Hebei 050000 (CN)

( * ) Notice: Subject to any disclaimer, the term of this patent is extended or adjusted under 35 U.S.C. 154(b) by 0 days.

(21) Appl. No.: 09/647,385

(22) PCT Filed: Mar. 30, 1999

(86) PCT No.: PCT/CN99/00040

§ 371 Date: Nov. 17, 2000

§ 102(e) Date: Nov. 17, 2000

(87) PCT Pub. No.: WO99/50604

PCT Pub. Date: Oct. 7, 1999

(30) Foreign Application Priority Data

Mar. 30, 1998 (CN) ..... 98101096
Jan. 20, 1999 (CN) ..... 99100310

(51) Int. Cl.[7] ..... F25B 21/02
(52) U.S. Cl. ..... 62/3.7; 62/3.2
(58) Field of Search ..... 62/3.2, 3.3, 3.6, 62/3.7; 165/104.4

(56) References Cited

U.S. PATENT DOCUMENTS 4,639,542 A * 1/1987 Bass et al. ..... 136/210
4,802,929 A * 2/1989 Schock ..... 136/205
5,056,316 A * 10/1991 Chung ..... 62/3.2
6,233,944 B1 * 5/2001 Yamada et al. ..... 62/3.7

FOREIGN PATENT DOCUMENTS

CN 87213525 4/1988
CN 2129909 4/1993
CN 2189726 2/1995
CN 2202284 6/1995
JP 4-126973 A * 4/1992 ..... 62/3.2

OTHER PUBLICATIONS

English Translation of the Abstract of CN 2189726 dated Feb. 15, 1995.
English Translation of the Abstract of CN 87213525 dated Apr. 12, 1988.
English Translation of the Abstract of CN 2129909 dated Apr. 14, 1993.
English Translation of the Abstract of CN 220284 dated Jun. 28, 1995.

* cited by examiner

*Primary Examiner*—Henry Bennett
*Assistant Examiner*—Melvin Jones
(74) *Attorney, Agent, or Firm*—Ladas & Parry

(57) ABSTRACT

A thermoelectric cooling device using heat pipes for heat conducting and dispersing, comprising a multi-bundle of the heat pipe conducting plates installed at the cold end of the thermoelectric cooling member and converged to condenser, a multi-bundle of the heat pipe heat exchangers installed at the hot end of the thermoelectric cooling member with fin plates or fin stripes and converged to the evaporator. It performs a fast cooling and heat dispersing by heat pipes and high efficient phase change and heat transport of the working medium. It can eliminate the heat exchange produced by the heat accumulation on the cold and hot ends, so as to run at the minimum operation temperature differences in order to obtain the maximum cooling capacity.

11 Claims, 5 Drawing Sheets

THERMOELECTRIC COOLING DEVICE USING HEAT PIPE FOR CONDUCTING AND RADIATING

FIELD OF THE PRESENT INVENTION

The present invention relates to a technique and an equipment for the thermoelectric cooling, in particular, to a heat conducting and dispersing equipment used in the thermoelectric cooling device.

PRIOR ART

The thermoelectric cooling is a benefit of the so-called Peltier effect which utilizes the potential change of the electrons and the holes in a circuit including two dissimilar conductors, and the phenomenon of the heat absorption and discharge which produces a hot end and a cold end, to perform cooling (or heating) functions. Since there is a current flowing through the thermocouple during operation of the cooler, the Joule heats will be created, at the same time, the temperature at the hot end tends to expand to the cold end, thus at a thermal equilibrium situation, the equilibrium equation will be as follows:

$$Q_c=a_{pn}T_cI-0.5I^2R-K(T_n-T_c)$$

That is, the amount of cooling at the cold end is equal to the Peltier cooling effect subtracted by a half of the Joule heat carried to the cold end, then subtracted by the heat transferred from the hot end to the cold end according to Fourier Heat Conducting Rule. It can also be derived from the above equation that, in case of not changing the materials of the thermocouple and the means for heat conducting and dispersing, both the cooling effect and the cooling efficiency tend to be zero when the temperature difference between the cold end and the hot end is the maximum. Therefore, in order to enhance the cooling efficiency, in addition to select a proper working current and a power for minimizing the Joule heat carried into the cold end, the most important fact for accessing the maximum cooling effect is to improve the means for heat conducting and dispersing in the thermoelectric cooling components, to minimize the heat exchange produced by the heat accumulation on both the ends and to reduce the temperature difference between the two ends. Therefore, the development of a high efficient heat conducting and dispersing equipment is very important for improving the operation condition of the thermoelectric cooling device, enhancing the cooling efficiency, enlarging the cooling volume, and obtaining a broader application, etc.

The thermoelectric cooling device used frequently in the recent years is composed of three components: a thermoelectric cooling member, a cooling transmitting member and a hot-end heat dispersing member. The thermoelectric cooling member is generally made of the semi-conducting materials. The cooling transmitting member uses a rib radiator or a large area metal plate. The hot-end heat dispersing member can be cooled by several means such as free cooling by a radiator, enforced cooling by a fan, free cooling by an internal water circulation, enforced cooling by an external water circulation, and heat absorbing by other materials, etc. For example, a room refrigerator shown in FIG. 1 uses a rib radiator; a vehicle-carried refrigerator shown in FIG. 2 uses a large area metal plate as the heat conductor at the cold end and a round needle-like radiator at the hot end; a refrigerator shown in FIG. 3 uses a rib radiator at the cold end and an internal free water circulation at the hot end; a refrigerator shown in FIG. 4 uses a round needle-like radiator at the cold end and an enforced external cooling water circulation at the hot end. In FIG. 1–4, the reference sign H, C and F are used to represent the heating space, the cooling space of cold end, and the fan, respectively. It is known from a long period of research and development that the heat conducting and dispersing member made of a kind of metal (FIGS. 1 & 2 ) has a heat exchange coefficient of only 3~8 w/(m$^2$k),and of 26–30 w/(m$^2$k) in the case of enforcet cooling with associated fans. Because of having heat resistance, the efficient heat conducting area is limited within a circle centered at the hot source and having a radius of 150 mm–180 mm. Outside this area, the heat conducting capability reduces significantly. For an internal water circulation (FIG. 3), the heat exchange coefficient can be as high as 110–170 w/(m$^2$k), however, it needs a relatively large circulation volume to perform the heat exchange with the environment. Thus, it is difficult to manufacture and easy to get leaking and corrosion during the installation. For an external water circulation (FIG. 4), the inlet and outlet of the water circulation for heat discharging are connected to a pressurized water supply and the heat is brought out by the external water circulation. The heat exchange coefficient of this type can be as high as 150–1000 w/(m$^2$k), however, a corresponding water supply and a water pump is necessary, the application is thus limited. In a heat dispersing member that utilizes principle of the heat from melting, the heat from solving and heat capacity of the materials, the disadvantages are resulted from the corrosion of the conducting components, the non-continuity and the instability of the heat discharging therefore, this type of the heat dispersing is not used widely. For all above mentioned reason, it is a urgent subject to develop a high efficient heat conducting and dispersing device in the thermoelectric cooling technology.

SUMMARY OF THE PRESENT INVENTION

An object of the present invention is to provide a thermoelectric cooling device that uses a heat pipe to conduct and disperse heat and applies evaporation and condensation (phase change) to absorb and discharge heat, so that achieves a high efficient and large area heat conduction and dispersion.

The object of the present invention can be realized with a thermoelectric cooling device used for various of the thermoelectric cooling apparatus and products. It uses a heat pipe as the heat conducting and dispersing means. It comprises: (1) a thermoelectric cooling member being composed of a cold and a hot ends; (2) a cooling transmission member being composed of a trapezoidal condenser attached to the cold end of the thermoelectric cooling member and a multi-bundle of the heat pipe conductors arranged between the trapezoidal condenser and the cooling space; (3) a heat dispersing member at the hot end, comprising a trapezoidal evaporator attached to the hot end of the thermoelectric cooling member, and a multi-bundle of the heat pipe radiators arranged between the trapezoidal evaporator and the heat dispersing space; (4) a phase-changeable working medium filled into above-mentioned cooling transmission member and the hot-end heat dispersing member.

In the most preferred embodiment, said multi-bundle of the heat pipes form a closed circulation with the trapezoidal condenser and the trapezoidal evaporator respectively, the working medium flows in this circulation. That is, in the cooling transmission member, each heat pipe extends upwardly from the top end of the trapezoidal condenser, passing the cooling space, and connects downwardly to the bottom end of the trapezoidal condenser; while in the hot-end heat dispersing member, each heat pipe extends upwardly from the top end of the trapezoidal evaporator, passing through the heat dispersing space, and connects downwardly to the bottom end of the trapezoidal evaporator.

BRIEF DESCRIPTION OF THE ACCOMPANYING DRAWINGS

The thermoelectric cooling device using the heat pipe to conduct and disperse heat according to the present invention will be described in more details with reference to accompanying drawings, in which.

BEST MODE FOR CARRYING OUT THE PRESENT INVENTION

Figure 1:
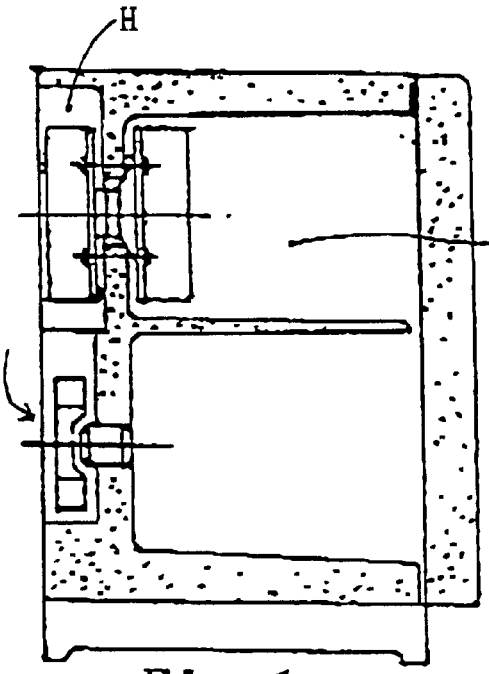
FIG. 1 is a schematic view showing a thermoelectric cooling device with a rib radiator for heat conducting and dispersing in a room refrigerator according to the prior art.
Figure 2:
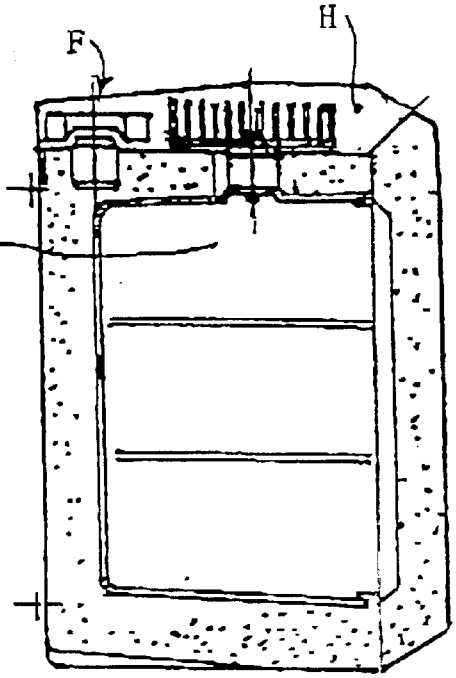
FIG. 2 is a schematic view showing a thermoelectric cooling device with a large area metal plate at the cold end and a round needle-like radiator at the hot end for heat conducting and dispersing according to the prior art.
Figure 3:
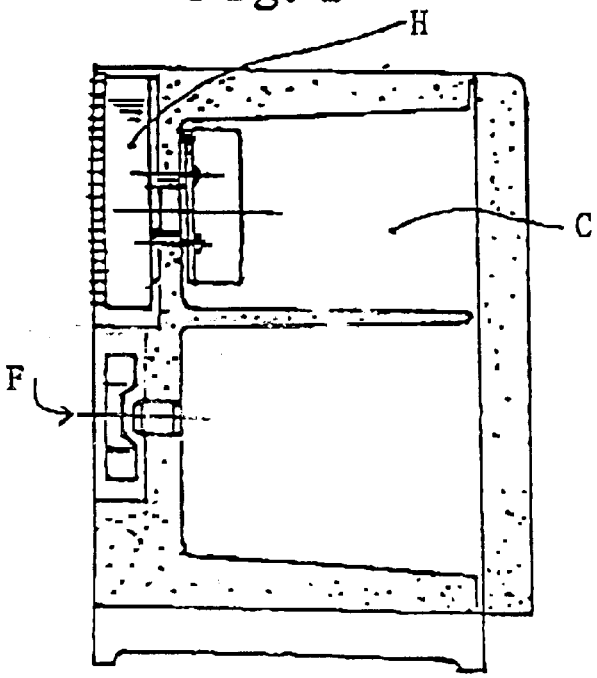
FIG. 3 is a schematic view showing a thermoelectric cooling device with a rib radiator at the cold end and an internal free cooling water circulation at the hot end in a refrigerator according to the prior art.
Figure 4:
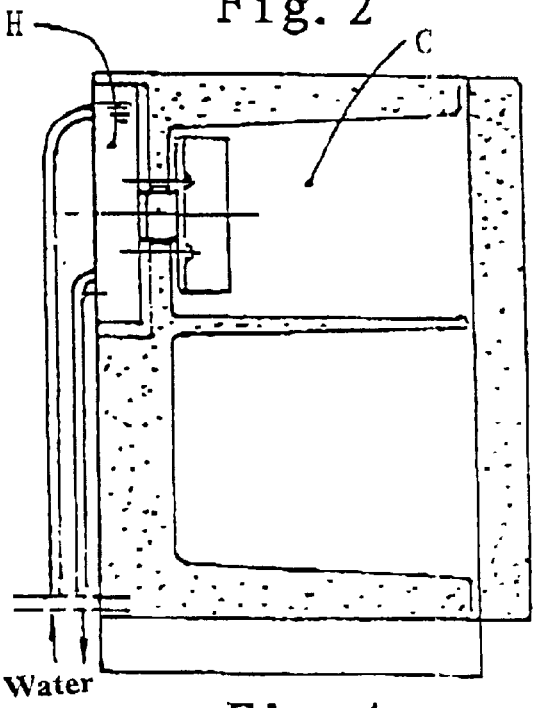
FIG. 4 is a schematic view showing a thermoelectric cooling device with a round needle-like radiator at the cold end and an externally enforced cooling water circulation at the hot end in a refrigerator according to the prior art.
Figure 5A:
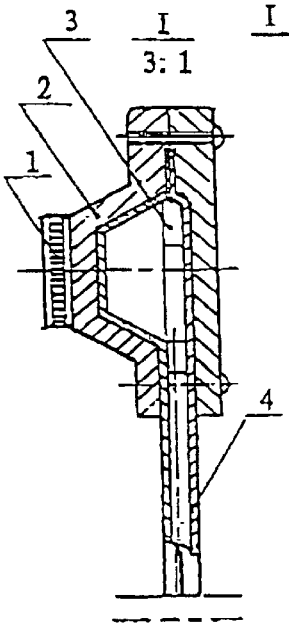
FIGS. 5A, 5B and 5C are schematic views showing the structure of the cooling conducting member of the thermoelectric cooling device using a heat pipe for heat conducting and dispersing and sectional enlargement of the beat pipe according to the present invention.
Figure 5C:
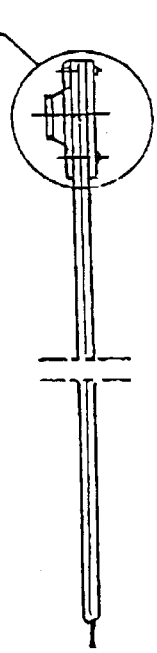
Figure 5B:
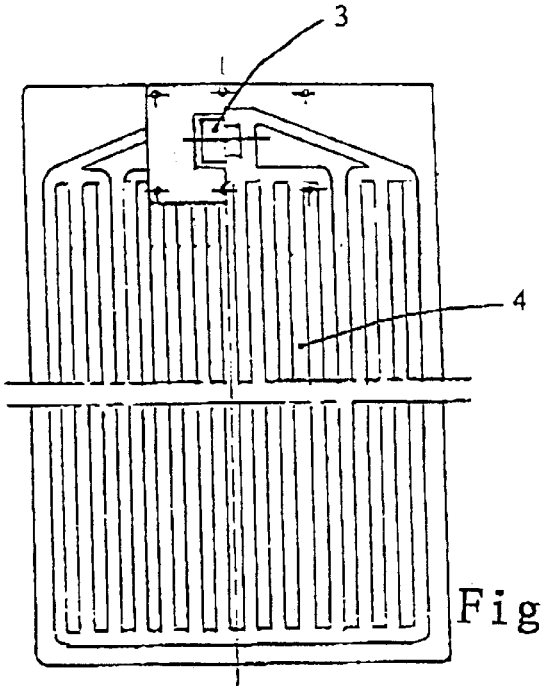
Figure 6A:
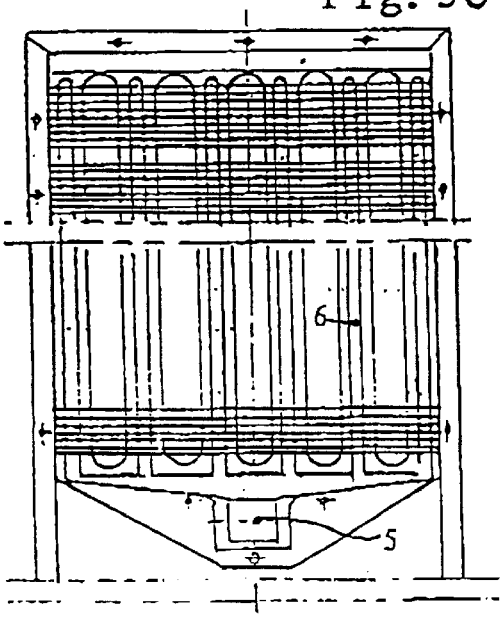
FIGS. 6A, 6B and 6C are schematic views showing the structure of the heat dispersing member at the hot end of the thermoelectric cooling device using a heat pipe for heat conducting and dispersing and sectional enlargement of the heat pipe according to the present invention.
Figure 6B:
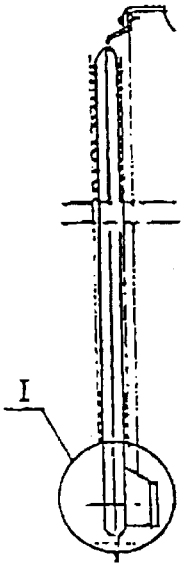
Figure 6C:
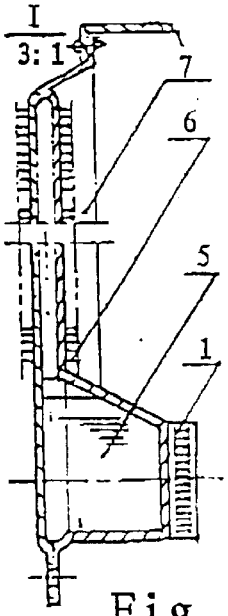
Figure 7A:
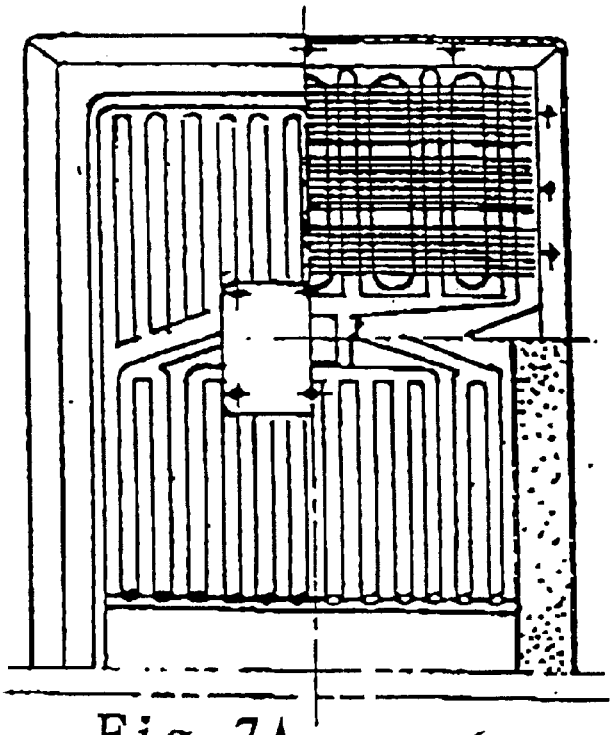
FIGS. 7A and 7B are respectively assembly view and sectional view of the thermoelectric cooling device using a heat pipe for heat conducting anti dispersing according to the present invention.
Figure 7B:
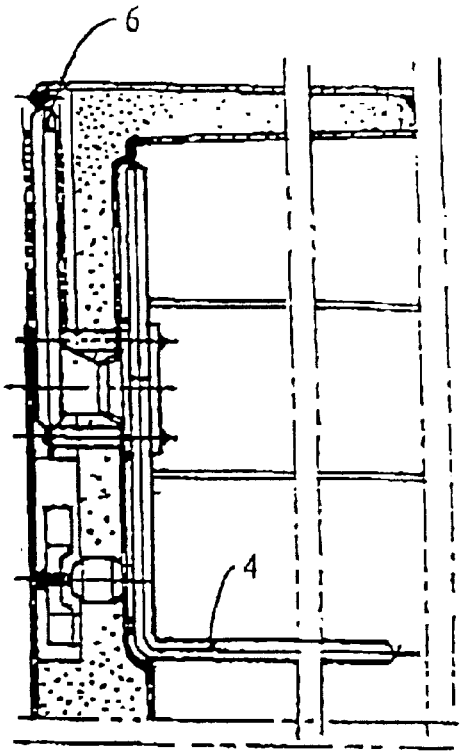

A thermoelectric cooling device using heat pipe for heat conducting and dispersing according to the present invention is shown in FIGS. 5–7. It comprises: (1) a cooling and conducting device being composed of a thermoelectric cooling member 1, a trapezoidal cooling block 2 arranged at the cold end of the thermoelectric cooling member, and a multi-bundle of the heat pipe conducting plates 4 fixed on the trapezoidal cooling block and converged to the trapezoidal condenser 3, as shown in FIG. 5; and (2) a heat dispersing member being composed of a plurality of heat-pipe heat exchangers 6 installed on the hot end of the thermoelectric cooling member 1 with fin stripes and converged to the trapezoidal evaporator 5, and an outer casing 7 connected around a heat pipe radiator (see FIG. 6). The thermoelectric cooling device using heat pipe for heat conducting and dispersing (as shown in FIG. 7) utilizes a heat pipe assembly to conduct and discharge heat. The operation principle is described below. After warming up the heat pipe at the hot end of the thermoelectric cooling member, the working medium filled in the heat pipe absorbs the external heat and is evaporated. It flows to another end of the heat pipe by a slightly different pressure and exchanges the heat with the environment, discharges the heat to outside. Its temperature is going down and it is condensed to liquid. The liquid returns to the hot end by the capillary elevation function with the help of a metal mesh abutting against a wall and is evaporated again (in a gravitational heat pipe, there is no liquid sucking core inside the pipe cavity, the liquid will return by its weight). This cycle will be repeated again and again, so as to transfer the heat from the hot end to another end quickly and continuously. Since the heat transfer is performed by means of the phase change of the working medium, the heat resistance inside the heat pipe will be very small, so that a significant heat transfer efficiency can be achieved at a relative small temperature difference and under an isothermal condition. According to the related references, the heat conducting efficiency of the heat pipe can be as high as 40–10000 times of that of copper under a certain range of the temperature and area, so that the heat pipe is a component having a very high heat transferring efficiency.

Figure 11A:
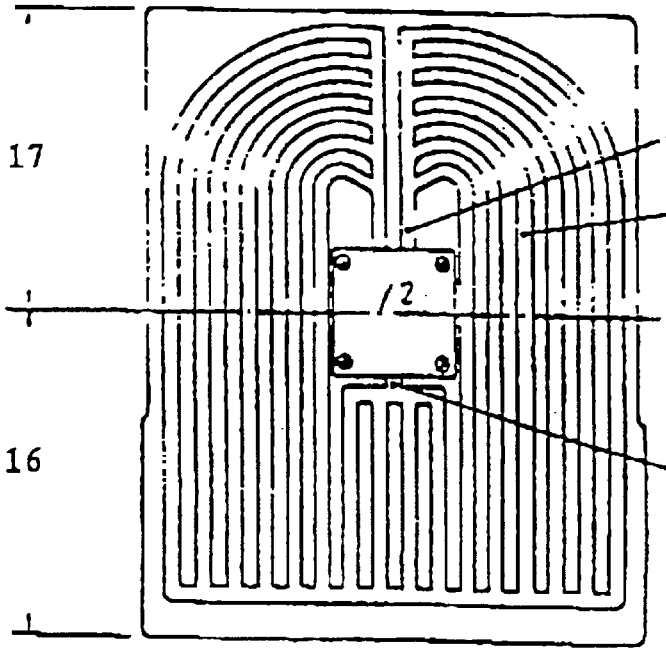
FIGS. 11A and 11B are views respectively showing the cooling conducting member of circular-type heat pipe conducting plate and showing this circular-type heat pipe.
Figure 11B:
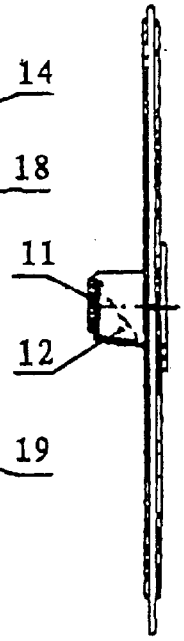
Figure 12A:
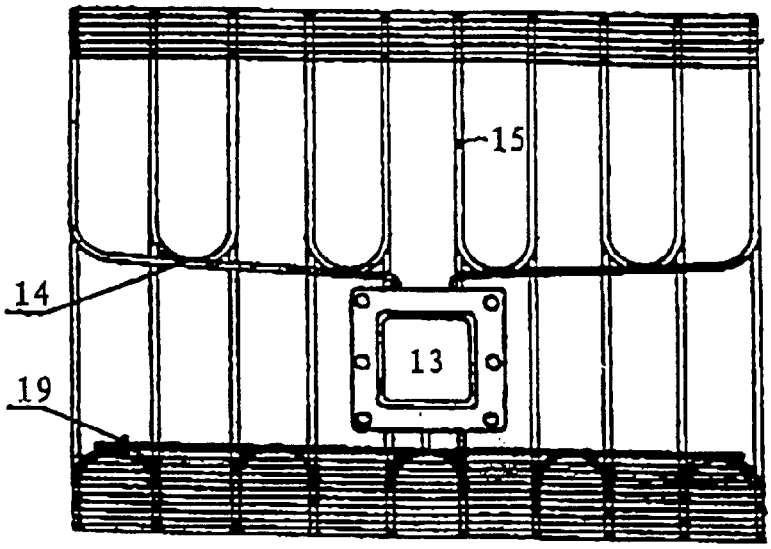
FIGS. 12A and 12B are respectively a view showing the hot-end heat dispersing member of the circular-type heat pipe radiator and a sectional view showing this circular heat pipe.
Figure 12B:
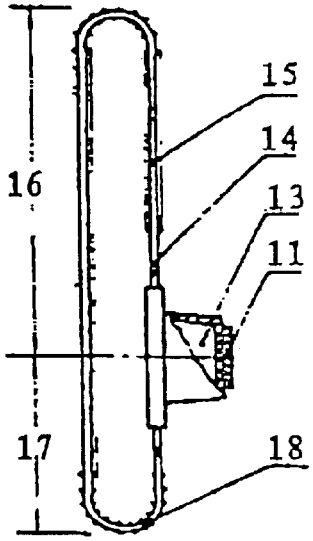

The heat pipe of the present invention can also be of a circulation type, i.e. said multi-bundle of the heat pipes connect to the trapezoidal condenser and the evaporator, respectively, so as to form a closed circuit and make the working medium flow within this circuit. In the cooling conducting member, each bundle of heat pipes extend upwardly from the top end of the trapezoidal condenser, passing through a cooling space and going downwardly so as to connect the bottom end of the trapezoidal condenser. In the hot-end heat dispersing member, each bundle of the heat pipe is drawn upward from the top end of the trapezoidal evaporator passing through a dispersing space and going downwardly so as to connect the bottom end of the trapezoidal evaporator. More details can be seen in FIGS. 11–12. Main features are as follows. A cooling and conducting device comprises a thermoelectric cooling member 11, a trapezoidal condenser 12 closely attached to the cold end of the thermoelectric cooling member, multi-bundle evaporating pipes 18 arranged at an evaporating section 17 of the working medium with the multi-bundle heat pipes are communicated with one another by means of the main evaporating passage 14 on the top end of trapezoidal condenser and turn downwardly at the two sides, and a main returning passage 19 in which a plurality of the evaporating pipe communicating with each other and converging into the bottom end of the condenser (FIGS. 11A and 11B). A hot-end heat dispersing device comprising a trapezoidal evaporator 13 closely attached to the hot end of the thermoelectric cooling member 11, multi-bundle condensing pipes 15 communicated with each other by a main evaporating passage 14 on the top end of trapezoidal evaporator and returning downwardly after reaching top position, multi-bundle evaporating pipes 18 formed on the evaporating section of the working medium, and a main returning passage 19 used for the multi-bundle evaporating pipes communicated with each other, returned upwardly and converged to the bottom end of the evaporating chamber (FIGS. 12A, 12B). The cooling plate of the circular heat pipe is manufactured by means of a plate blowing-up method that is commonly used in making a refrigerator evaporator. The circular heat pipe radiator is manufactured as making the wire tube condenser of the refrigerator. Though different in process and structure, the circulation passage, the operation principle and the construction form are all similar in general.

The circular heat pipe radiator is an example to describe working principle of the circular heat pipe. FIGS. 12A and 12B show the hot-end heat dispersing device. After starting the thermoelectric cooling member and raising the hot end temperature, the working medium in the evaporating chamber 13 of the heat pipe radiator is heated and evaporated, and it flows rapidly into the condensing end on the upper part of the heat pipe. Since the evaporating pipe 18 located at the bottom end of the radiator is obviously lower than the heat source and the corresponding evaporating chamber 13, there is no heat transfer by circulation and radiation of the heat source in this region except the conduction by a main returning tube 19. So the influence to the temperature of the evaporating pipe is very small. A relatively large temperature difference is formed between the evaporation section 17 and the conduction section 16, (in general, it is 12–15° C., about 10 times of that in a typical gravitational heat pipe), thus a relatively large vapor pressure difference is produced between the evaporation section 17 and the circular condensing pipe 5. This large pressure difference will push vapor to flow through the top end of condensing pipe 15 to the evaporating pipe 18 in which there is a minimum pressure. At the same time, the vapor makes a heat exchange with the ambient through the wall of a pipe during flowing in the condensing pipe 15. Thus, the vapor is condensed into a liquid film on the wall of the pipe, releasing heat to the ambient and lowing temperature. In addition, because the pressure difference inside the cavity of the pipe is relatively large, the vapor flows rapidly during process of climbing to the top end of the heat pipe 15, resulting in small thickness of the liquid film staying on the wall of a pipe. After arriving at the top end and returning down, the vapor flows slowly, most of which will be condensed in this section. The liquid layer flows down to the evaporating pipe 18 by its gravity and vapor pressure in the same direction. The liquid level of the working medium in the evaporating pipe is in general at the center of the heat source 13 (the filling volume of the working medium in a circular heat pipe is at the center of heat source, it is not accounted by the volume ratio of the pipe cavity), thus low temperature working medium accumulated in the evaporating pipe can be added to the evaporating chamber continuously and evaporated again. Repeat the circulation, the heat at the hot end will be transferred to each condensing pipe quickly so as to discharge heat and make condensation available.

FIGS. 11A and 11B show a cold-end cooling conducting device. This device only uses cooling space 17 as its heat source, the working medium absorbs heat through the multi-bundle evaporating pipe 18. The evaporated working medium flows into the trapezoidal condenser 12 and condenses. After cooling and condensing through the thermoelectric cooling member 11, the working medium flows back to the evaporator and evaporates again. The principle of operation is stated as above. Since this circular heat pipe radiator adopts a design that the evaporating pipe is located lower than the heat source or the condensing pipe is located higher than the cold source, a relatively large temperature difference is built between the evaporation section and the condensation section. Thus, a increased pressure is obtained so that the vapor flows, most of the vapor is then condensed in the side condensing pipes. Therefore, separate circulation of the vapor and the liquid is realized, and the speeds of the evaporation, the condensation and flowing back of liquid membranes are all increased. The heat exchange area located below the heat source and above the cold source is enlarged, this not only significantly increases efficiency of the heat transfer and the cooling capability, but also reduces works load of welding, reduces the production cost, and improves commercial appearance of the products.

The method to make the thermoelectric cooling device using heat pipe according to the present invention is described below. At first, one needs to determine the maximum temperature difference between the hot end and the cold end of the thermoelectric cooling member. Second, the working medium of the heat pipe in accordance with a temperature range on the cold and the hot ends is selected. In order to guarantee a proper operation condition of the heat pipe, the working medium must be a vapor-liquid dual substance. Its melting point should be lower and its critical temperature should be higher than the operation temperature of the heat pipe. It is also necessary to consider compatibility of the working medium with materials of the heat pipe shell and the liquid absorbing cork The reason is that, if the shell or absorbing core reacts with the medium, or the medium is decomposed, non-condensing gas will be produced. Any chemical reaction will corrupt the shell of the core, degrade the heat pipe, shorten its life time, and more seriously, stop operation of the heat pipe For the common room refrigerator, the vehicle-carried refrigerator and the freezer, the working medium filled in the cold end of thermoelectric cooling device can be a liquid ammonia, an acetone, or non-CFC refrigerants. After selecting the working medium, one can design the circulation passageway, the connection structure and the working are a of the heat pipe conducting plate and the heat pipe heat exchanger in accordance with temperatures at the both ends of the thermoelectric cooling member and the evaporating speed of the medium. Such determined tube diameter, the end cover and the connection structure should be checked with the operation pressure. An extreme operation condition is also necessary to be predicted so as to have a safety coefficient. In the aspect of the construction and the process means, a shaping method by hot-pressing and blow-expending a double-layer aluminum plate can be used to make conduction plate of the heat pipe. It can also adopt a method for cold-pressing and roll-welding a double-layer steel plate. This structure has advantages of mature technique, reliable sealing effect, high operation pressure with relatively thin materials, small heat resistance, and high conducting efficiency. A compact arrangement of different forms of the circulation pipes can be achieved in such a structure. It is an ideal cooling transport structure for all thermoelectric cooling device.

The heat dispersion by the heat pipe can be enhanced by adding fins on the tube or using a multi-bundle of metal tubes with the welded fin stripes. It is better to use radially arranged tubes to connect to the evaporating chamber for reducing resistance and increasing flow speed.

In designing and manufacturing of the heat-pipe conducting pipes and the heat-pipe exchangers, it is necessary to minimize the number of the welding points, to eliminate the usage of the welding materials that are not compatible with the working medium in order to prevent the medium leakage and the local corrosion. Before filling the medium, an over-loaded pressure test with the maximum operation pressure should be taken. The working medium should be filled with a proper liquid ratio according to the tube volume and the vapor-liquid percentage. At the room temperature, this ratio (the liquid medium volume the total tube volume) is usually 10–20%.

Some examples of the thermoelectric cooling device using the heat pipe for heat conducting and dispersing according to the present invention are given as follows.

EXAMPLE 1

Figure 8:
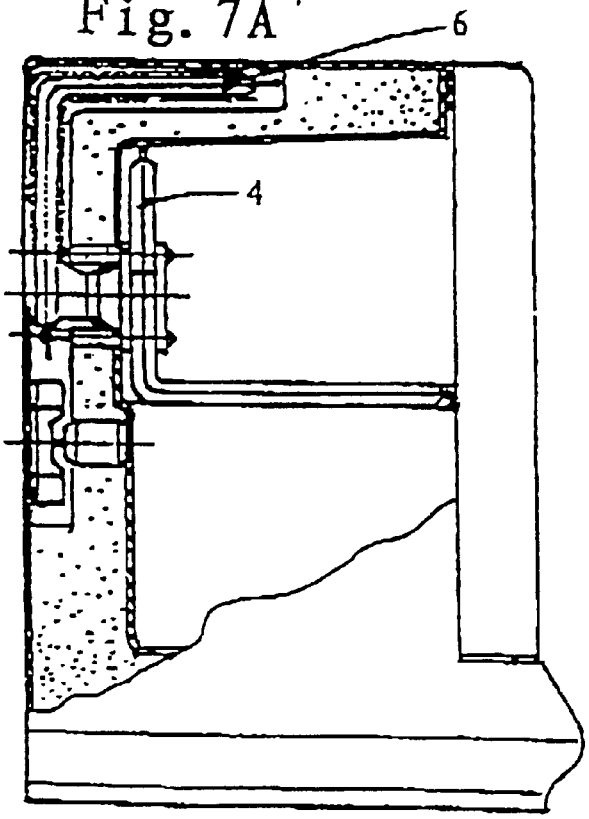
FIG. 8 is a schematic view of the thermoelectric cooling device using a gravitational heat pipe for heat conducting and dispersing used in a room refrigerator.

This is a device used for a room refrigerator. A gravitational heat pipe is used (see FIG. 8). The heat-pipe conducting plates that are formed by the blow-expending processes are used on the cold end. The heat-pipe radiator 6 that has a multi-bundle of tubes with the fin stripes is used on the hot end.

EXAMPLE 2

Figure 9:
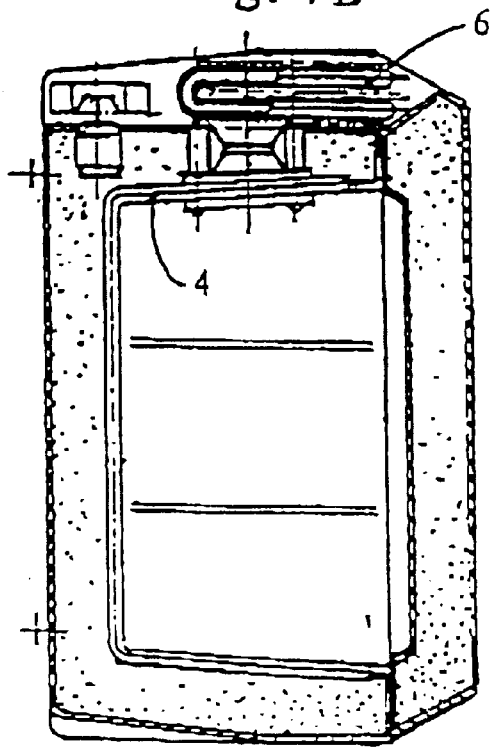
FIG. 9 is a schematic view of the thermoelectric cooling device using a cored heat pipe for heat conducting and dispersing used in a vehicle-carried refrigerator.

This is a device used for a vehicle-carried refrigerator. A cored heat pipe is used (see FIG. 9). The heat-pipe conducting plate 4 is formed by a hot-pressing and blow-expanding process. The hot end is provided with a heat-pipe radiator 6 that has a multi-bundle heat pipes with liquid-absorbing core inside and the finned strips on outside surface. The working medium inside this cored heat pipe can be returned to the heating end by the capillary force without the influence of the gravity. More area of the heat pipe can be obtained on the heating end in order to compensate weakness existing on the structure of the device.

EXAMPLE 3

Figure 10A:
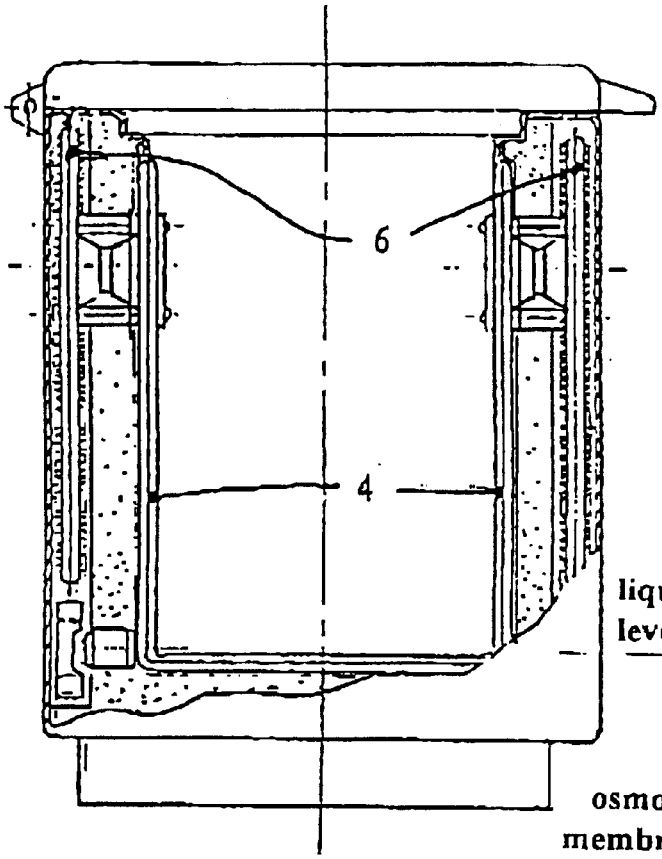
FIGS. 10A and 10B are respectively sectional view and side view of the thermoelectric cooling device using an osmotic pressure heat pipe for heat conducting and dispersing used in a freezer.
Figure 10B:
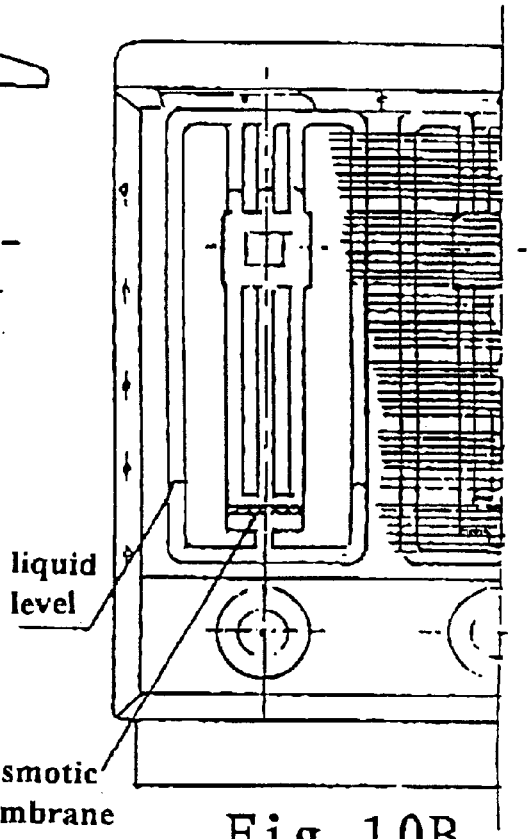

This is a device used for a freezer. It is a thermoelectric cooling device using the osmotic-pressure heat pipe for heat conducting and dispersing (see FIG. 10). The cold end adopts a heat-pipe cold-conducting plate which is formed by a hot-pressing and blow-expanding process. The hot end is provided with a heat exchanger having osmotic-pressure heat-pipes. This kind of the heat pipe can utilize a pressure difference between two sides of the osmotic membrane to pump the condensed working medium from the lower cooling section to the higher heating section. Therefore, the cooling pipe can be lowered down for the maximum utilization of the heat dispersing space. It is more of practicability and flexibility in arrangement of the structure of the device.

EXAMPLE 4

Figure 13:
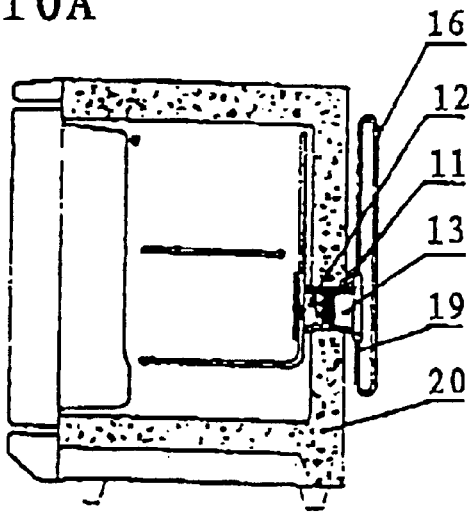
FIG. 13 is a schematic view showing the thermoelectric cooling device using circular heat pipe for heat conducting and dispersing.

This is a device used for a room refrigerator. As shown in FIG. 13, the reference number 20 represents a refrigerator body, other numbers represent the same components as those similar in FIGS. 11–12. It is a device using the circulating heat pipe. The cold end adopts the circulating heat-pipe conducting plate that is formed by a blow-expanding process. A flat or curved cooling plate can be used in accordance with the volume of the cooling space. The hot end is provided with a circulating heat-pipe radiator that is formed by a wiring-tube process.

In summary, by utilizing the high efficient heat pipe, the thermoelectric cooling device using the heat pipe for heat conducting and dispersing according to the present invention has the advantages of being accelerated the heat transfer rate between the components of the thermoelectric cooling members, reduced the heat or cold accumulation and the heat exchange, minimized the temperature difference on the two ends, and increased the cooling efficiency. It is a device with a creative idea, an appropriate construction, a reliable operation, a low cost of its manufacture, a high practicability, a stable property, and a long life, etc. It can be used for various of the thermoelectric cooling device and products.

What is claimed is:

1. A thermoelectric cooling device using heat pipes for heat conducting and dispersing used for a various of the thermoelectric cooling equipment and products, comprising:

(1) a thermoelectric cooling member being composed of the thermoelectric cold and the hot ends;

(2) a cooling transport device being composed of a trapezoidal condenser attached to the cold end of said thermoelectric cooling member, and a multi-bundle of the heat pipe conductors arranged between said trapezoidal condenser and a cooling space;

(3) a hot-end heat dispersing device being composed of a trapezoidal evaporator attached to the hot end of said thermoelectric cooling member, and a multi-bundle of the heat pipe radiators arranged between said trapezoid evaporator and a heat dispersing space; and (4) a phase-changeable working medium filled in said cooling transport device and the hot-end heat dispersing device.

2. A thermoelectric cooling device using heat pipes for heat conducting and dispersing according to the claim 1, characterized in that said heat pipe conductor in the cooling transport device is a heat pipe conducting plate constructed by hot-pressing and blow-expanding processes or cold-pressing and roll-welding processes of double layer plates.

3. A thermoelectric cooling device using heat pipes for heat conducting and dispersing according to the claim 1, characterized in that said heat-pipe radiator of the hot-end heat dispersing device has fin plates or fin stripes on the outside surface.

4. A thermoelectric cooling device using heat pipes for heat conducting and dispersing according to the claim 1, characterized in that said phase-changeable working medium is selected from one of the following substances: liquid ammonia, acetone or non-CFC refrigerant.

5. A thermoelectric cooling device using heat pipes for heat conducting and dispersing according to the claim 1, characterized in that said phase-changeable working medium is filled with a ratio of 10–25% (the liquid working medium: the total volume of heat pipe) at the room temperature.

6. A thermoelectric cooling device using heat pipes for heat conducting and dispersing according to the claim 1, characterized in that the heat pipe of said hot-end heat dispersing device is a gravitational heat pipe.

7. A thermoelectric cooling device using heat pipes for heat conducting and dispersing according to the claim 1, characterized in that the heat pipe of said hot-end heat dispersing device is a cored heat pipe.

8. A thermoelectric cooling device using heat pipes for heat conducting and dispersing according to the claim 1, characterized in that the heat pipe of said hot-end heat dispersing device is an osmotic pressure heat pipe.

9. A thermoelectric cooling device using heat pipes for heat conducting and dispersing according to the claim 1, characterized in that said multi-bundle of the heat pipes respectively form a closed circulation with the trapezoidal condenser and trapezoidal evaporator, the working medium flows within this circulation, i.e. in the cooling transport device, each bundle of the heat pipes is drawn upwardly from the top end of the trapezoidal condenser, passing the cooling space, then connected downwardly to the bottom end of the trapezoidal condenser; in the hot-end heat dispersing device, each bundle of heat pipes is dawn upwardly from the top end of the trapezoidal evaporator, passing the heat dispersing space, then connected downwardly to the bottom end of the trapezoidal evaporators.

10. A thermoelectric cooling device using heat pipes for heat conducting and dispersing according to the claim 9, characterized in that said cooling transport device includes in sequence: a trapezoidal condenser, a main evaporating pipe connected to the top end of the condenser, a multi-bundle of the condensing pipes communicating to the main evaporating pipe, a multi-bundle of the condensing pipes returning downwardly at the two sides, a multi-bundle of the evaporating pipes formed in the working medium evaporating section (the pre-cooling space), said multi-bundle evaporating pipes communicating with each other and converged to a main liquid tube that is connected to the bottom end of the condenser;

said hot-end heat dispersing device includes in sequence: a trapezoidal evaporator, a main evaporating pipe connected to the top end of the evaporator, a multi-bundle of the evaporating pipes communicated to the main evaporating pipe, a multi-bundle of the evaporating pipe returning downwardly and converged to the main reflux tube.

11. A thermoelectric cooling device using heat pipes for heat conducting and dispersing according to the claim 10, characterized in that said evaporating pipe of circular-type heat pipe is located lower than the hot source (the evaporator), while the top end of the condensing pipe is located higher than the cold source (the condenser).

* * * * *